United States Patent [19]

Wagner

[11] 3,937,286

[45] Feb. 10, 1976

[54] FENCE POST DRIVER

[76] Inventor: Carl F. Wagner, Rte. 3 Box 79, Cushing, Okla. 74023

[22] Filed: May 13, 1974

[21] Appl. No.: 469,375

[52] U.S. Cl. ..... 173/119; 173/124

[51] Int. Cl.[2] ..... B25D 11/00

[58] Field of Search ..... 173/119, 120, 123, 124, 173/163, 117; 175/55, 56

[56] References Cited

UNITED STATES PATENTS

| | | | |
|---|---|---|---|
| 314,755 | 3/1885 | Tracy | 173/123 |
| 979,522 | 12/1910 | Malourie | 173/123 |
| 2,776,539 | 1/1957 | Pearson | 173/123 |
| 2,825,207 | 3/1958 | Cullum | 173/123 |
| 2,927,773 | 3/1960 | Wilke | 173/123 |
| 3,193,027 | 7/1965 | Bodine | 173/119 |
| 3,205,952 | 9/1965 | Sicotte | 173/124 |
| 3,734,207 | 5/1973 | Fishbein | 173/163 |

*Primary Examiner*—James A. Leppink
*Attorney, Agent, or Firm*—Head and Johnson

[57] ABSTRACT

A self-contained hand tool for driving fence posts into the earth and operable by an automobile battery, or the like. The tool comprises a sleeve member for receiving one end of the post therein, reciprocal hammer means disposed within the sleeve and intermittently engagable with the post, power means, cam means, drive means operably connected between the power means and the cam means for rotation thereof, extension strap means carried by the hammer means and engagable by the cam means during rotation thereof for moving the hammer means in one direction, and yieldable means connected with the hammer means for returning the hammer means to the normal position thereof against the action of the cam and strap means for providing said reciprocal movement for the hammer means.

2 Claims, 6 Drawing Figures

FENCE POST DRIVER

BACKGROUND OF THE INVENTION

1. Field of the Invention

This invention relates to improvements in fence post driving means and more particularly, but not by way of limitation, to a self-contained hand tool for driving fence posts into the earth.

2. Description of the Prior Art.

During the installation of fences, particularly those commonly known as cyclone fences, it is the usual practice to set a plurality of fence posts in the earth in spaced relation and stretch the fencing material therebetween. The fence posts are normally driven into the earth through a relatively substantial distance in order to provide stability for the fence structure. The site of installation of the fence is frequently in an area wherein access to the posts is somewhat restricted, that is, it may be difficult to position any vehicle powered or large driving equipment in the proximity of the post. The hand driving of the posts is difficult and time consuming since the earth is often extremely hard and rocky.

SUMMARY OF THE INVENTION

The present invention contemplates a novel self-contained hand tool particularly designed and constructed for facilitating the setting or driving of fence posts into the earth. The novel tool comprises a sleeve member adapted for receiving one end of the fence post therein and having a slidable disc member loosely disposed therein for resting on the upper end of the fence post. A hammer member is disposed in the sleeve on the opposite side of the disc member with respect to the fence post and is retained in a normal position against the disc member by suitable compression spring means. A strap member is provided on the outer extremity of the hammer member and is engagable by a rotatable cam member for moving the hammer in a direction away from the disc against the force of the spring. A power source is carried by the sleeve member and disposed externally thereof for driving the cam means. When the sleeve member is disposed on the fence post and the power source is activated, the cam means intermittently engages the strap member for moving the hammer in one direction and disengages the strap member whereby the spring means returns the hammer to the normal position thereof, thus applying intermittent striking forces against the disc which in turn applies the striking force to the fence post for driving of the fence post into the earth.

DESCRIPTION OF THE PREFERRED EMBODIMENT

Figure 1:
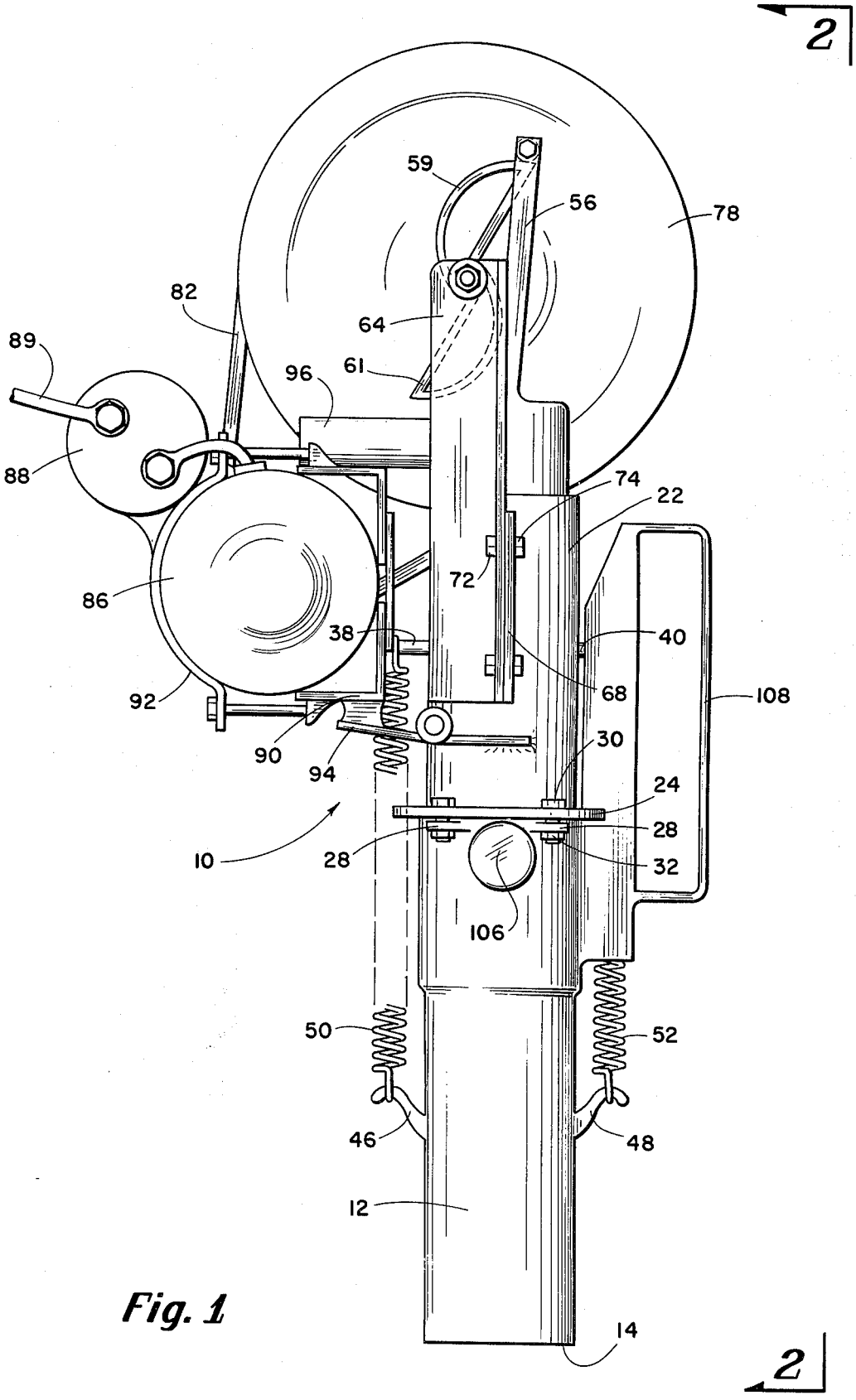
FIG. 1 is a side elevational view of a fence drive tool embodying the invention.

Referring to the drawings in detail, reference character 10 generally indicates a fence post driver hand tool comprising a first sleeve member 12 having one end 14 thereof open for receiving a fence post 16 therein. The opposite end of the sleeve 12 is enlarged at 18 to provide an annular shoulder 20 for a purpose as will be hereinafter set forth and to receive one end of a second sleeve 22 therein, as particularly shown in FIGS. 4 and 5. A pair of oppositely disposed circumferential flanges 24 and 26 are provided on the outer periphery of the sleeve 22 for engagement with the enlarged end portion 18 of the sleeve 18 in order to support the sleeve 22 therein. A plurality of radially outwardly extending apertured flanges or lugs 28 are provided on the outer periphery of the sleeve 12 in the proximity of the end 18 thereof and the sleeves 12 and 22 may be removably secured in end to end relation by a plurality of bolts 30 and lock nuts 32 threadedly secured between the flanges 24 and 26 and the lugs 28 and 32, as clearly shown in the drawings. A plate or disc member 34 (FIGS. 4 and 5) is slidably disposed within the enlarged end 18 of the sleeve 12 and is interposed between the sleeve 22 and the shoulder 20 for a purpose as will be hereinafter set forth.

Figure 5:
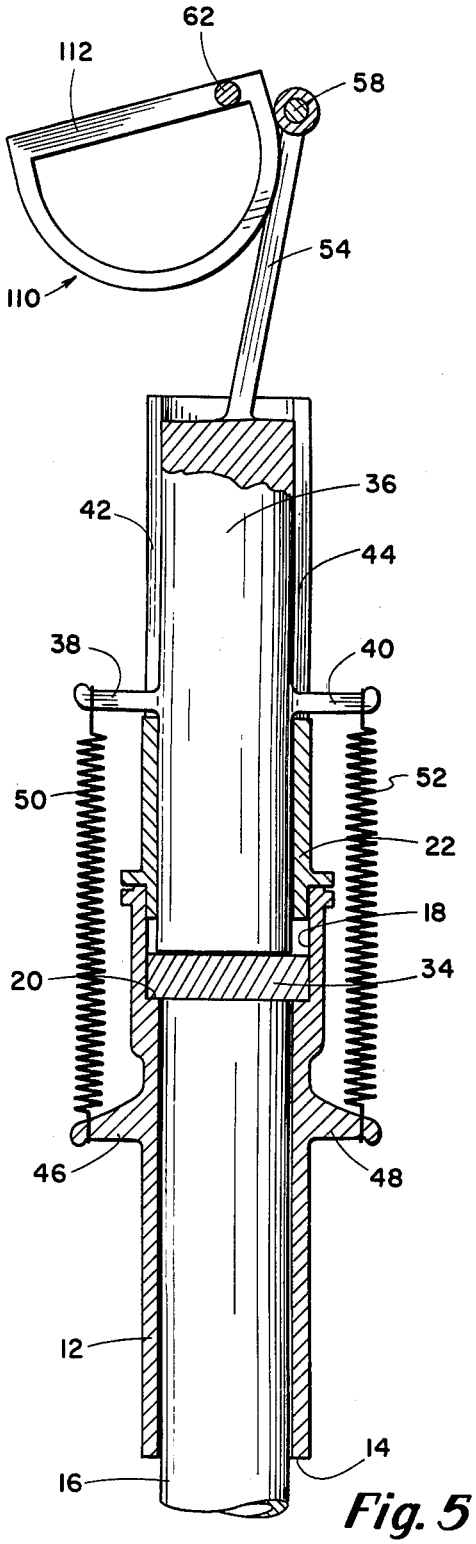
FIG. 5 is a view similar to FIG. 4 and illustrates the hammer in a normal position with respect to the sleeve.

An elongated hammer member 36 is slidably disposed within the sleeve 22 and is oppositely disposed therein with respect to the post 16. The hammer 36 may be of any suitable type, but is preferably lead-loaded whereby gravity will tend to retain the hammer 36 in a normal position against the disc 34 as shown in FIG. 5 when the device 10 is in use. A pair of oppositely disposed radially outwardly extending fingers 38 and 40 are provided on the outer periphery of the hammer 36 and extend slidably through a pair of oppositely disposed slots 42 and 44, respectively, provided in the sidewalls of the sleeve 22. A complementary pair of radially outwardly extending fingers 46 and 48 are provided on the outer periphery of the sleeve 12 and disposed in substantial alignment with the fingers 38 and 40. A first compression spring member 50 is secured or anchored between the aligned fingers 38 and 46 in any suitable manner and a second compression spring member 52 is similarly secured or anchored between the aligned fingers 40 and 48 in order to more positively maintain the hammer 36 in a normal position adjacent the disc 34.

A pair of spaced axially extending arms 54 and 56 are welded or otherwise rigidly secured to the outer extremity of the hammer member 36 and are connected at their outer ends by a cross member 58 which may be bolted or otherwise secured therebetween, thus providing a substantially inverted U-shaped strap member at the outer extremity of the hammer 36. The cross member 58 is intermittently engaged by a cam mechanism, generally indicated at 60, for intermittently moving the hammer 36 in a direction against the force of the springs 50 and 52 for a purpose and in a manner as will be hereinafter set forth.

Figure 2:
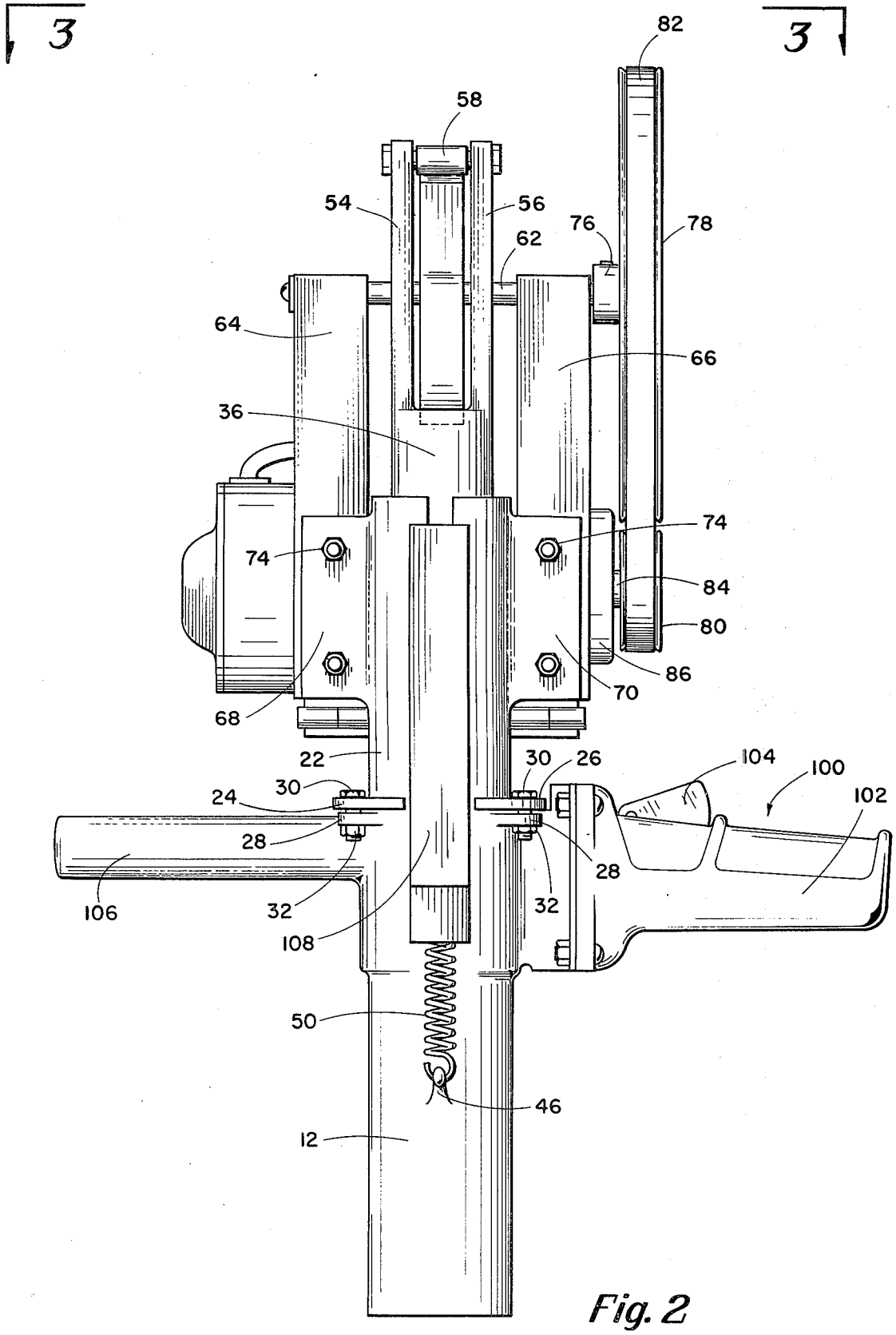
FIG. 2 is a view taken on line 2—2 of FIG. 1.
Figure 3:
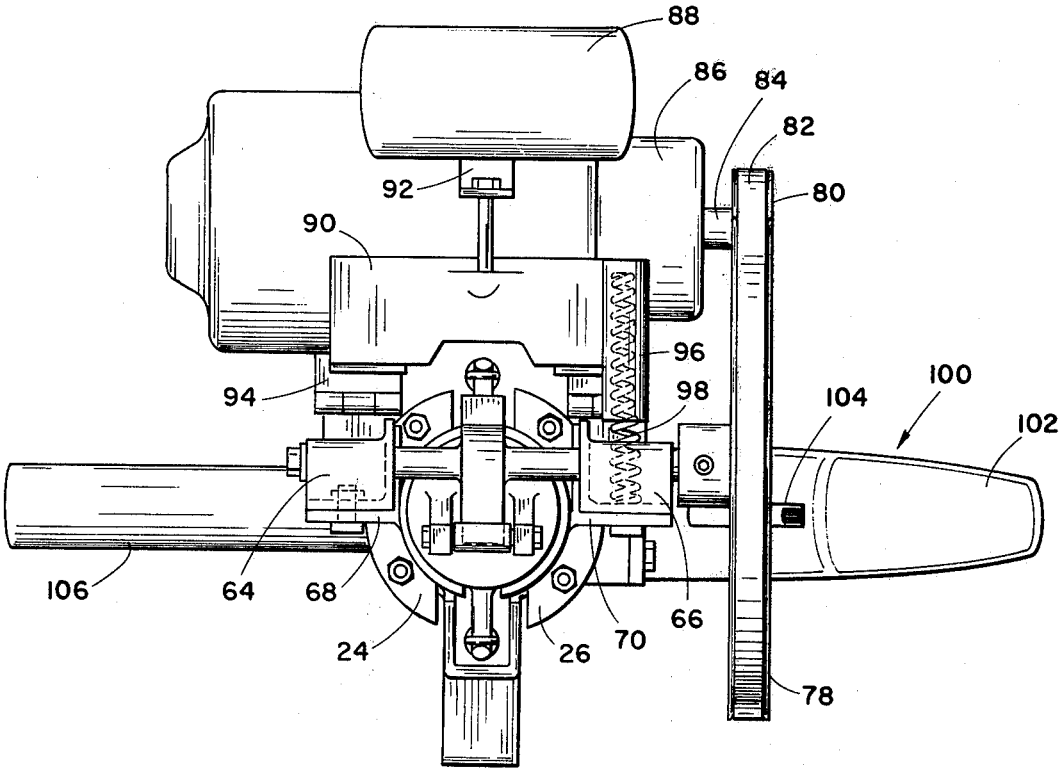
FIG. 3 is a view taken on line 3—3 of FIG. 2.

As particularly shown in FIGS. 1, 2 and 3, the cam mechanism 60 comprises a pair of oppositely disposed radially outwardly extending cam members 59 and 61 secured to a cam shaft 62 suitably journalled between a pair of spaced support members 64 and 66 which are preferably constructed from angle iron, but not limited thereto. The support members 64 and 66 are suitably secured to radially outwardly extending circumferentially spaced flanges 68 and 70, respectively, provided on the outer periphery of the sleeve 22. Whereas the supports 64 and 66 may be secured to the respective flanges 68 and 70 in any well known manner, as shown herein the supports are bolted to the flanges by a plurality of bolts 72 and complementary lock nuts 74. One end of the cam shaft 62 is supported in one of the support members, such as the support member 64 and the opposite end of the shaft 62 extends through the other support member, such as the support member 66 into connection with the hub 76 of a suitable pulley member 78. A second pulley member 80 is spaced from the pulley 78 and is in substantial planar alignment. An endless belt 82 extends around and between the pulleys 78 and 80, as is well known, for transmitting rotation therebetween. The pulley 80 is suitably secured to the drive shaft 84 of a motor 86 of any suitable type. The motor 86 as shown herein is preferably electric and is actuated by a solenoid 88 as will be hereinafter set forth. Whereas a pulley drive arrangement shown herein is used, it is to be understood that a worm and gear arrangement (now shown) may be operably connected between the drive shaft 84 and the cam shaft 62 for transmitting rotation to the shaft 62, if desired.

The motor 86 is removably mounted on a bracket 90 in any suitable manner, such as a strap arrangement 92. The mounting bracket 90 is secured to the outer periphery of the sleeve 22 by a suitable hinge 94. A tubular housing 96 is welded or otherwise rigidly secured to the bracket 90 spaced from the hinge 94 as particularly shown in FIG. 1 and has one end thereof closed for receiving one end of a suitable compression spring 98 thereagainst and the opposite end thereof open for passage of the spring 98 therethrough. The outer end of the spring 98 is suitable anchored or secured to the support member 66 as particularly shown in FIG. 3 and constantly urges the bracket 96 in a direction away from the sleeve 22 in order to maintain the belt 82 taut between the pulleys 78 and 80. When it is desired to release the tension in the belt 82 for any reason, the motor 86 may be manually moved in a direction toward the sleeve 22 for pivoting the bracket 90 in a direction against the force of the spring 98. Of course, when the manual pressure is released, the spring 98 will return the motor 86 to the normal position thereof.

The solenoid 88 is operably connected or electrically connected with the motor 86 in any suitable well known manner for actuation thereof and a suitable cable 89 is provided for connecting the solenoid 88 with a battery (not shown) which is preferably of a 12 voltage but not limited thereto and is also suitably electrically connected with an on-off switching mechanism 100 which is mounted in a housing 102 secured to the outer periphery of the sleeve 12. The switching mechanism 100 is preferably provided with a trigger-type actuation element 102 and the housing 102 functions as a handle for facilitating manipulation of the tool 10 as will be hereinafter set forth. In addition, it is preferable to provide an oppositely disposed radially outwardly extending rod or handle member 106 rigidly secured to the outer periphery of the housing 12 whereby the housing 102 may be grasped by one hand of the tool operation (not shown) and the handle member 106 may be grasped by the operator's other hand for supporting the tool 10 during operation thereof. In addition, a longitudinally extending handle member 108 may be secured to the outer periphery of the sleeve 22 for facilitating carrying of the tool 10 between installation sites.

Figure 4:
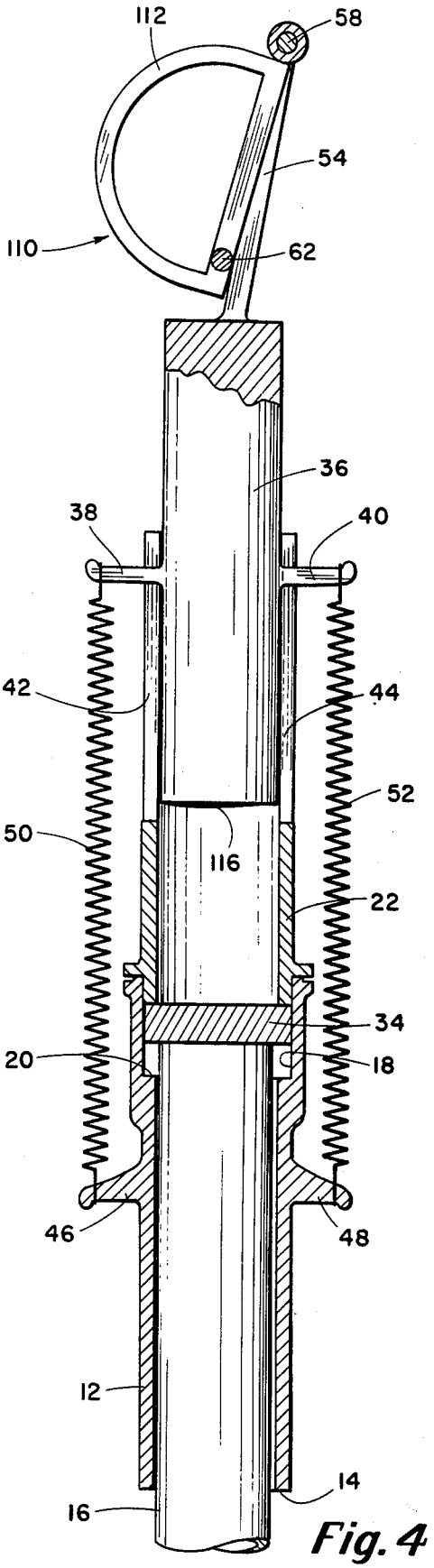
FIG. 4 is an enlarged sectional elevational view of the sleeve and hammer means of the invention and illustrates the hammer is an extended position with respect to the sleeve.

Referring now to FIGS. 4 and 5 a modified cam means 110 is shown which is substantially identical to the cam mechanism 60 except that a single cam member 112 is secured to the cam shaft 62 in lieu of the two cams 59 and 61 hereinbefore set forth. It will be apparent that upon rotation of the cam shaft 92, the cams 59 and 61 will alternately engage the cross member 58, causing an extension of the hammer member 36 two times during each revolution of the shaft 62, whereas with the use of a single cam member 112, the cam 112 will engage the cross member 58 one time during each revolution of the shaft 62 and will thus extend the hammer member 36 once for each revolution of the shaft 62.

Figure 6:
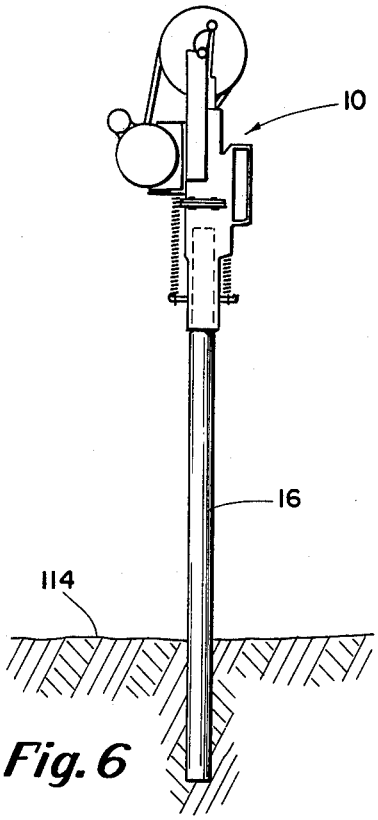
FIG. 6 is a side elevational view, partly in section, depicting a fence post driver embodying the invention in position on the upper end of a fence post.

When the tool 10 is to be utilized for driving the post 16 into the earth 114, the sleeve 12 may be placed on the upper end of the post 16 as particularly shown in FIG. 6 and the motor 86 may be activated by manual operation of the switch 100 as is well known. The drive shaft 84 is rotated in the usual manner upon the activation of the motor 86 for transmitting rotation to the pulley 80. The rotation of the pulley 80 is transmitted to the pulley 78 through the belt 82 as is well known and the cam shaft 62 is rotated simultaneously with the pulley 78. As the cam shaft 62 rotates, the cam members 59 and 61 are alternately moved into and out of engagement with the cross member 58. As one of the cam members, such as the cam 59, engages the cross arm 58, the arm 58 is moved in a direction against the force of the springs 50 and 52 and the hammer 36 is pulled longitudinally or axially outward with respect to the sleeve 22. Continued rotation of the cam shaft 62 moves the cam 59 away from engagement with the cross member 58 and gravity and the spring members 50 and 52 quickly return the hammer to the contracted position within the sleeve 22. It will be apparent that each cam 59 and 61 will engage the cross arm 58 one time during each revolution of the shaft 62, thus, the hammer member 36 will be moved against the force of the springs and released two times during each revolution of the shaft 62. Of course, if the single cam 112 is utilized the hammer 36 will be reciprocated only a single time during each revolution of the cam shaft 62.

When the hammer 36 is returned to the normal contracted position thereof within the sleeve 22, the outermost end 116 of the hammer 36 strikes the disc 34 which is resting on the uppermost end of the post 16, as particularly shown in FIGS. 4 and 5. The force of the hammer 36 striking the disc 34 drives the disc 34 and post 16 downwardly with each blow of the hammer. When the hammer 36 is moved to the raised position therefor as shown in FIG. 4, the disc 34, which normally rests on the uppermost end of the post 16, is also disposed against the lowermost end of the sleeve 22. When the hammer 36 drops to the lowermost position thereof, as shown in FIG. 5, the disc 34 and post 16 are driven downwardly for driving the post 16 into the earth 114. The downward movement of the hammer 36 is limited by the engagement of the disc 34 with the shoulder 20.

Of course, a pilot hole (not shown) may be initially drilled or dug in the earth 14 at the site wherein the post 16 is to be set, if desired, and the post 16 may be driven into the earth to substantially any desired depth below the pilot hole. The pilot hole may subsequently be filled with concrete, or the like, to provide further stability for the installed post 16, as is well known.

Subsequent to the setting of the post 16 in the earth 114, the tool 10 may be manually removed from the position on the top of the post 16 and may be manipulated by the longitudinally disposed handle 108 for portability to the site of the next or succeeding post 16 to be set. Of course, during the post driving operation, the tool 10 may be manipulated by the handles 102 and 106 which greatly facilitate the overall handling of the tool.

From the foregoing it will be apparent that the present invention provides a novel self-contained portable fence post driving tool powered by a suitable battery. The tool may be easily disposed on the uppermost end of the post to be driven or set and reciprocal hammer means having yieldable means constantly urging the hammer in one direction, and cam means engagable with the hammer for intermittent driving engagement with the post for driving the post into the earth. The tool is easily supported by the post itself during the post driving operation and the hammering operation quickly drives the post into the earth with a minimum of effort for the operator of the tool. The novel tool is simple and efficient in operation and economical and durable in construction.

Whereas the present invention has been described in particular relation to the drawings attached hereto, it should be understood that other and further modifications, apart from those shown or suggested herein, may be made within the spirit and scope of this invention.

What is claimed:

1. A fence post driving tool comprising sleeve means having one end thereof open for receiving one end of a fence post therein, hammer means slidably disposed in said sleeve means and movable through the opposite end thereof, yieldable means secured between the sleeve means and the hammer means for constantly urging the hammer means in one direction with respect to the sleeve means, cam means journalled in the proximity of one end of the hammer means and intermittently engagable therewith for moving the hammer means in a direction against the force of the yieldable means, power means carried by the sleeve means, drive means operably connected between the power means and cam means for actuating of the cam means, and said cam means and yieldable means cooperating to reciprocate the hammer means within the sleeve means for transmitting intermittent driving force to the fence post, and wherein the hammer means comprises an elongated hammer element slidably disposed within said sleeve means, U-strap means secured to the outer extremity of said hammer element and extending longitudinally outwardly therefrom, said U-strap means being intermittently engagable by said cam means for imparting movement to the hammer element in one direction against the force of the yieldable means.

2. A fence post driving tool as set forth in claim 1 wherein the hammer element is lead weighted and said yieldable means comprises at least one compression spring member secured between the sleeve means and the hammer element.

* * * * *